US010991535B2

(12) United States Patent
Zhang et al.

(10) Patent No.: US 10,991,535 B2
(45) Date of Patent: Apr. 27, 2021

(54) MINIATURE CIRCUITS BREAKER OPERATING MECHANISM AND MINIATURE CIRCUIT BREAKER

(71) Applicant: Xiamen Hongfa Electrical Safety & Controls Co., Ltd., Xiamen (CN)

(72) Inventors: Xiaofang Zhang, Xiamen (CN); Hang Zou, Xiamen (CN); Yanhai Zhou, Xiamen (CN); Yun Ma, Xiamen (CN)

(73) Assignee: Xiamen Hongfa Electrical Safety & Controls Co., Ltd., Xiamen (CN)

( * ) Notice: Subject to any disclaimer, the term of this patent is extended or adjusted under 35 U.S.C. 154(b) by 0 days.

(21) Appl. No.: 16/717,664

(22) Filed: Dec. 17, 2019

(65) Prior Publication Data

US 2020/0203109 A1 Jun. 25, 2020

(30) Foreign Application Priority Data

Dec. 24, 2018 (CN) ..... 201811583010.7

(51) Int. Cl.
*H01H 71/54* (2006.01)
*H01H 71/50* (2006.01)

(52) U.S. Cl.
CPC ..... *H01H 71/54* (2013.01); *H01H 71/505* (2013.01)

(58) Field of Classification Search
CPC ..... H01H 71/54; H01H 71/505; H01H 37/52; H01H 3/00
USPC ..... 200/17 R, 401–402, 553; 337/59, 68
See application file for complete search history.

(56) References Cited

U.S. PATENT DOCUMENTS 6,486,417 B1 * 11/2002 Toyama ..... H01H 71/54 200/17 R
2019/0189379 A1 * 6/2019 Ostrovsky ..... H01H 71/64

FOREIGN PATENT DOCUMENTS

CN 207558723 U 6/2018

* cited by examiner

*Primary Examiner* — Edwin A. Leon
*Assistant Examiner* — Iman Malakooti
(74) *Attorney, Agent, or Firm* — Wolf, Greenfield & Sacks, P.C.

(57) ABSTRACT

The present disclosure discloses a miniature circuit breaker operating mechanism and a miniature circuit breaker. The operating mechanism includes an operating handle and a lock catch. The operating handle and the lock catch are separately rotatably connected to a circuit breaker housing. The operating mechanism further includes: a first connecting rod, which is rotatably connected with the circuit breaker housing, and the rotating shaft of the first connecting rod and the rotating shaft of the lock catch shares the axis or on the same axis; a moving contact is arranged on the first connecting rod; a second connecting rod; the second connecting rod is connected with the operating handle, and the second connecting rod, the lock catch and the first connecting rod cooperate with a linkage structure.

12 Claims, 9 Drawing Sheets

MINIATURE CIRCUITS BREAKER OPERATING MECHANISM AND MINIATURE CIRCUIT BREAKER

RELATED APPLICATIONS

This application is based upon and claims foreign priority benefits under 35 U.S.C. § 119(a)-(d) or 35 U.S.C. § 365(b) to Chinese Patent Application 201811583010.7, filed on Dec. 24, 2018, the entire contents of which are incorporated herein by reference.

TECHNICAL FIELD

The present disclosure relates to an operating mechanism, and particularly, to a miniature circuit breaker operating mechanism and a miniature circuit breaker.

BACKGROUND

The Chinese utility model patent CN207558723U discloses a miniature circuit breaker operating mechanism, which includes a mechanism frame, a handle, a first connecting rod, a second connecting rod, a third connecting rod, a tension spring and a moving contact. A third axis of the mechanism frame is rotatably provided with a jumping buckle, and the fourth axis of the mechanism frame is provided with a lock catch which is matched with the jumping buckle. The restoration tension spring is arranged between the lock catch and the side plate of the mechanism frame. The first connecting rod and the second connecting rod are connected through a U-shaped rod, and the second connecting rod corresponding to the jumping buckle is provided with an arc-shaped guide hole. One end of the U-shaped rod penetrates into the arc-shaped guide hole, and can slide back and forth in the arc-shaped guide hole with the first connecting rod. The other end of the U-shaped rod is connected with the handle, and the third axis is rotatedly provided with a rotating plate matched with the U-shaped rod. A torsional spring is provided between the rotating plate and the side plate of the mechanism frame, and the rotating plate is provided with an arc-shaped slot clamped with a U-shaped rod.

SUMMARY

The present disclosure provides a miniature circuit breaker operating mechanism, including an operating handle for realizing circuit breaker opening and closing, a lock catch for keeping the moving contact of the circuit breaker in a closing state. The operating handle and the lock catch are rotatably connected to the circuit breaker housing, respectively; and the operating mechanism further includes:

A first connecting rod, which is rotatably connected to the circuit breaker housing, and the rotating axis of the first connecting rod and the rotating axis of the lock catch are coaxial or on the same axial line; the moving contact is arranged on the first connecting rod;

A second connecting rod;

The second connecting rod is connected with the operating handle, and is matched with the lock catch and the first connecting rod to cooperate with a linkage structure. When the operating handle is rotating to the closing position, the second connecting rod can drive the lock catch and the first connecting rod to rotate to realize closing, and when the lock catch is tripped, the position limit of the moving contact and the first connecting rod is released, so that the moving contact and the first connecting rod are restored under the action of a first elastic member.

Furthermore, the linkage structure includes a sliding slot arranged on the first connecting rod, a first convex shaft arranged on the second connecting rod, and a first acting portion arranged on the lock catch. The first convex shaft is slidably connected into the sliding slot. The first acting portion is provided with a pressing state in which the first convex shaft is tightly pressed against the inner wall of the sliding slot, and a separating state separated from the first convex shaft. In the pressing state, the second connecting rod can drive the first connecting rod and the lock catch to rotate. In the separating state, the lock catch releases the position limit of the moving contact and the first connecting rod.

Furthermore, a second elastic member is arranged between the lock catch and the circuit breaker housing. When the operating handle is rotated to the opening position, the lock catch is under the action of the second elastic member, so that the first acting portion thereof is restored to a state of being pressed against the first convex shaft.

Furthermore, a third elastic member is arranged between the operating handle and the circuit breaker housing. A second acting portion is arranged on the lock catch. When the operating handle is rotated a first angle to the opening position under the action of the third elastic member, the lock catch is under the action of the second elastic member, so that the second acting portion thereof tightly presses the first convex shaft against the inner wall of the sliding slot, to restrict the operating handle to continue rotating to the opening position.

Furthermore, the operating mechanism further includes a stop portion, which is arranged on the circuit breaker housing. When the lock catch is rotated a second angle with the first connecting rod, the stop portion presses against the acting position of the second elastic member to the lock catch, so that the second elastic member releases the lock catch.

Furthermore, the first elastic member and the second elastic member are integrally connected to form a double twist spring. Two spiral portions of the double twist spring are sleeved on the rotating shaft of the lock catch. One foot of the double twist spring is lapped on the lock catch, and the other foot is lapped on the circuit breaker housing. The connection portion between the two spiral portions of the double twist spring is hooked the moving contact.

Furthermore, the sliding slot includes an upper slot section, a middle slot section and a lower slot section. The bottom end of the upper slot section is connected with the top end of the lower slot section through the middle slot section. When the first convex shaft of the second connecting rod slides from the upper slot section to the middle slot section, the second connecting rod drives the first connecting rod and the lock catch to rotate as the operating handle continues to rotate to the closing position.

Furthermore, the sliding slot includes an upper slot section and a lower slot section, and the bottom end of the upper slot section is connected with the bottom end of the lower slot section through a middle slot section. When the first convex shaft of the second connecting rod slides from the upper slot section to the middle slot section, the second connecting rod drives the first connecting rod and the lock catch to rotate as the operating handle continues to rotate to the closing position. When the operating handle rotates a first angle to the opening position under the action of the third elastic member, the second acting portion of the lock catch tightly presses the first convex shaft against the inner wall of the lower slot section.

Furthermore, the operating handle is provided with a shaft hole, and the second connecting rod is provided with a second convex shaft. The second convex shaft is movably inserted into the shaft hole.

Furthermore, the moving contact is hinged on the first connecting rod, and the first connecting rod is provided with a receiving slot. The moving contact is provided with a bump block. The bump block is fitted into the receiving slot and has a gap with the slot wall of at least one side of the receiving slot.

The present disclosure further provides a miniature circuit breaker, which includes a housing, a moving contact, a stationary contact, an operating mechanism and a tripping mechanism. The operating mechanism is the miniature circuit breaker operating mechanism of the present disclosure above mentioned.

The present disclosure will be further described in detail below with reference to the accompanying drawings and embodiments. However, a miniature circuit breaker operating mechanism and miniature circuit breaker of the present disclosure is not limited to the embodiments.

DETAILED DESCRIPTION

Figure 1:
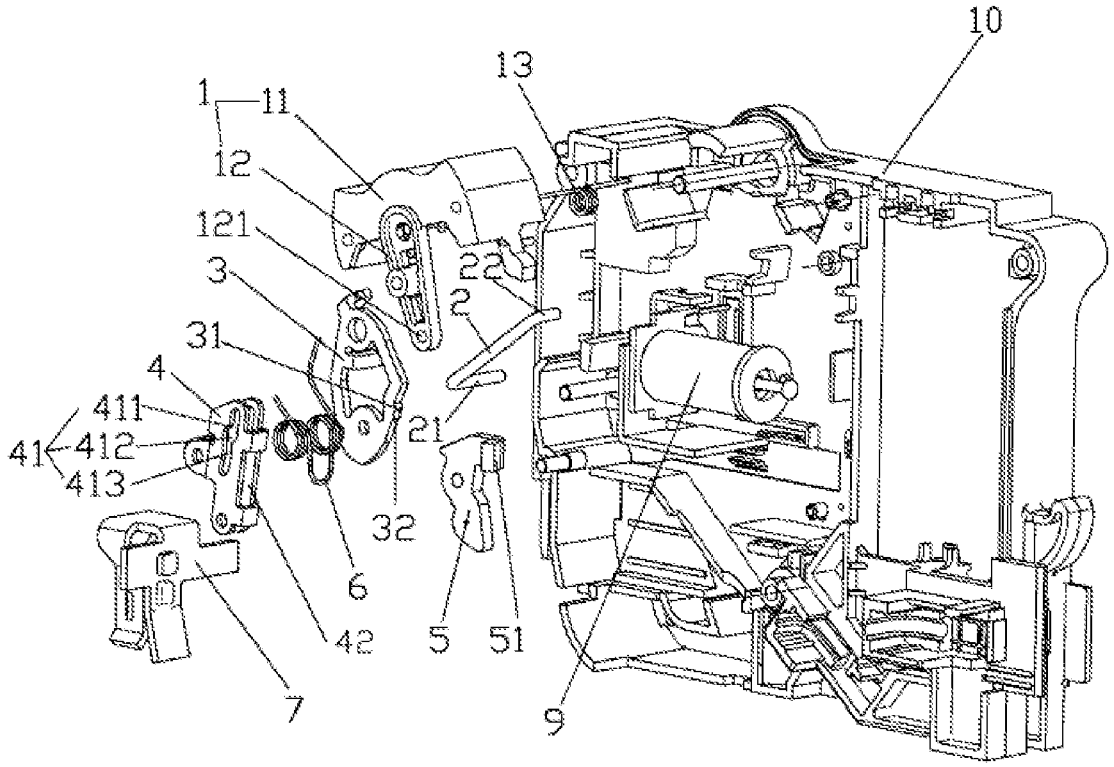
FIG. 1 is the decomposition schematic diagram of the present disclosure.

For the embodiments, please refer to FIG. 1 to FIG. 9, a miniature circuit breaker operating mechanism of the present disclosure, includes an operating handle 1 for realizing the opening and closing of the circuit breaker, a lock catch 3 for keeping a moving contact 5 of the circuit breaker in the closing state. The operating handle 1 and the lock catch 3 are rotatably connected to a circuit breaker housing 10, respectively. The operating mechanism of the present disclosure further includes:

A first connecting rod 4, which is rotatably connected to the circuit breaker housing 10, and the first connecting rod 4 and the lock catch 3 share the same rotating shaft 101; the moving contact 5 is arranged on the first connecting rod 4;

A second connecting rod 2;

The second connecting rod 2 is connected with the operating handle 1, and is matched with the lock catch 3 and the first connecting rod 4 to cooperate with a linkage structure. When the operating handle 1 is rotated to the closing position, the second connecting rod 2 can drive the lock catch 3 and the first connecting rod 4 to rotate to realize closing, and when the lock catch 3 is tripped, the position limit of the moving contact 5 and the first connecting rod 4 is released, so that the moving contact 5 and the second connecting rod 2 are restored under the action of a first elastic member.

In the present embodiment, the linkage structure includes a sliding slot 41 arranged on the first connecting rod 4, a first convex shaft 21 arranged on the second connecting rod 2, and a first acting portion 31 arranged on the lock catch 3. The first convex shaft 21 is slidably connected into the sliding slot 41. The first acting portion 31 is provided with a pressing state in which the first convex shaft 21 presses tightly against the inner wall of the sliding slot 41, and a separating state separated from the first convex shaft 21. In the pressing state, the second connecting rod 2 can drive the first connecting rod 4 and the lock catch 3 to rotate. In the separating state, the lock catch 3 release the position limit of the moving contact 5 and the first connecting rod 4.

In the present embodiment, a second elastic member is arranged between the lock catch 3 and the circuit breaker housing 10. When the operating handle 1 is rotated to the opening position, the lock catch 3 is under the action of the second elastic member, so that the first acting portion 31 thereof is restored to a state of being pressed against the first convex shaft 21.

In the present embodiment, a third elastic member 13 is pressingly arranged between the operating handle 1 and the circuit breaker housing 10. A second acting portion 32 is arranged on the lock catch 3. When the operating handle 1 is rotated a first angle to the opening position under the action of the third elastic member 13 (the first angle is smaller than the rotation angle of opening and closing of the operating handle 1), the lock catch 3 is under the action of the second elastic member, so that the second acting portion 32 tightly presses the first convex shaft 21 against the inner wall of the sliding slot 41, to restrict the operating handle 1 to continue rotating to the opening position. In this way, the operating handle 1 is maintained at a setting position between the opening position and the closing position, so that the personnel can judge the failure of the circuit breaker by the position of the operating handle 1, and quickly carry out emergency treatment. Therefore, the setting position can be defined as a fault position. The first angle can be preferably set as half of the rotation angle of the opening and closing of the operating handle 1, so that when the operating handle 1 is rotated to the intermediate position, it corresponds to the fault position.

In the present embodiment, the operating mechanism of the present disclosure further includes a rod-shaped stop portion 102, which is arranged on the circuit breaker housing 10. When the lock catch 3 is rotated a second angle with the first connecting rod 4 (the second angle is far less than the rotation angle when the lock catch 3 rotates to the end with the first connecting rod 4), the stop portion 102 presses the acting end of the second elastic member against the lock catch 3, so that the second elastic member releases the lock catch 3. In this way, the tripping mechanism of the circuit breaker can push the lock catch 3 to release without overcoming the elastic force of the second elastic member, thereby not only making the tripping action faster, but also making the tripping mechanism designed simpler and more energy-saving.

In the present embodiment, the first elastic member and the second elastic member are integrally connected to form a double twist spring 6. The two spiral portions 61 of the double twist spring 6 are sleeved on the rotating shaft 101 of the lock catch 3. One foot 62 of the double twist spring 6 is lapped on the lock catch 3, and the other foot 63 is lapped on the circuit breaker housing 10 (specifically, the other foot 63 is lapped on the stop portion 102), and the connection portion 64 between the two spiral portions 61 of the double twist spring 6 is hooked the moving contact 5. When the lock catch 3 is rotated the second angle with the first connecting rod 4, the stop portion 102 presses against one foot 62 of the double twist spring 6. The lock catch 3 is provided with a hollow structure for the stop portion 102 to pass through, so that one end of the stop portion 102 can press against one foot 62 of the double twist spring and the other end presses against the other foot 63 of the double twist spring.

In the present embodiment, the first acting portion 31 and the second acting portion 32 are both convex structures arranged on the side of the lock catch 3, but are not limited thereto. The first acting portion 31 and the second acting portion 32 are located on the same side of the lock catch 3.

In the present embodiment, the sliding slot 41 includes an upper slot section 411, a middle slot section 412 and a lower slot section 413. The bottom end of the upper slot section 411 is connected with the top end of the lower slot section 413 through the middle slot section 412. When the first convex shaft 21 of the second connecting rod slides from the upper slot section 411 to the middle slot section 412, the second connecting rod 2 drives the first connecting rod 4 and the lock catch 3 to rotate as the operating handle 1 continues to rotate to the closing position. In this way, the operating handle 1 can have a section of empty stroke relative to the first connecting rod 4, so that it is convenient to install an abnormal protection device controlled by the operating handle 1 on the circuit breaker. That is, when the circuit breaker start the leakage and/or arc fault protection function of the circuit breaker through the operating handle 1 to self-test, the movement of the operating handle 1 will not affect the original opening state of the circuit breaker. Only when the leakage and/or arc fault protection function of the circuit breaker is normal, the personnel can continue to turn the operating handle 1 for closing. When the operating handle rotate a first angle to the opening position under the action of the second elastic member, the second acting portion of the lock catch tightly presses the first convex shaft against the inner wall of the lower slot section 413. The sliding slot 4 is obliquely arranged, and the inclination angle of the middle slot section 412 is smaller than the inclination angle of the upper slot section 411 and the lower slot section 413. In this way, when the first convex shaft 21 of the second connecting rod slides from the upper slot section 411 to the middle slot section 412, the second connecting rod 2 can drive the first connecting rod 4 and the lock catch 3 to rotate under the pressing action of the first acting portion 31 of the lock catch.

In the present embodiment, the operating handle 1 is provided with a shaft hole 121, and the second connecting rod 2 is provided with a second convex shaft 22. The second convex shaft 22 is movably inserted into the shaft hole 121.

In the present embodiment, the moving contact 5 is hinged on the first connecting rod 4, and the first connecting rod 4 is provided with a receiving slot 42. The moving contact 5 is provided with a bump block 51. The bump block 51 fits into the receiving slot 42 and has a gap with the slot wall of at least one side of the receiving slot 42. In this way, not only the first connecting rod 4 driving the movement of the moving contact 5 and the moving contact 5 driving the restoration of the first connecting rod 4 are not affected, but also the first connecting rod 4 has an over travel relative to the moving contact 5, so that when the moving contact 5 is in closing position, the moving contact is reliably contacted with the stationary contact, and the first connecting rod 4 is prevented from hardly acting on the moving contact 5 that resulting in wear of the components due to continuous rotation.

In the present embodiment, the operating handle 1 includes an operating block 11 and a rotating rod 12, and the operating block 11 are exposed outside the circuit breaker housing 10 and have a button structure. The top end of the rotating rod 12 is connected with the middle position of the operating block 11, and the rotating rod 12 is rotatably connected on the circuit breaker housing 10, and is hidden in the circuit breaker housing 10 along with the other components of the operating mechanism. The shaft hole 121 is arranged on the rotating rod 12, and the third elastic member 13 is specifically a twist spring. The spiral portion of the twist spring is sleeved on the rotating shaft 103 of the rotating rod 12, and the two feet of the twist spring are pressed against the circuit breaker housing 10 and the operating block 11 of the operating handle 1, respectively. When operating, pressing one end of the operating block 11 can push the entire operating handle 1 to rotate to realize the closing of the circuit breaker, and pressing the other end of the operating block 11 can push the entire operating handle 1 to rotate in the reverse direction to realize the opening of the circuit breaker or return the operating handle 1 to the opening position. The two ends of the top surface of the operating block 11 are respectively provided with "ON" and "OFF" marks, which respectively corresponding to the closing position and the opening position of the operating handle 1. Since the operating handle 1 also has the fault position, a fault position marks can be set at an intermediate position on the top surface of the operating block 11.

In the present embodiment, the second connecting rod 2 has a U-shaped structure, and the two ends of the U-shaped structure correspond to the first convex shaft 21 and the second convex shaft 22, respectively.

Figure 2:
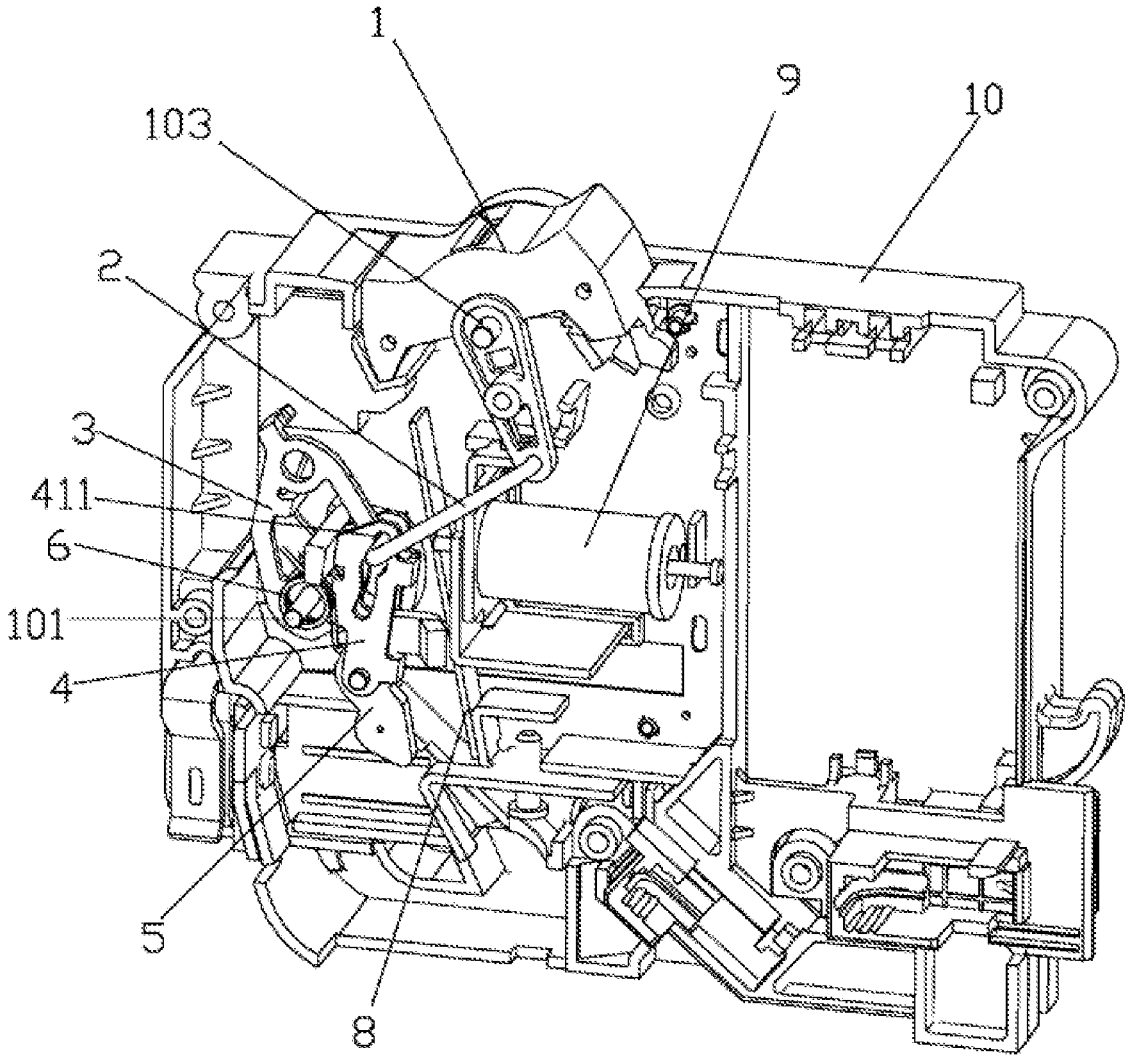
FIG. 2 is the structure schematic diagram one of the present disclosure in which the operating handle is in the opening position.
Figure 3:
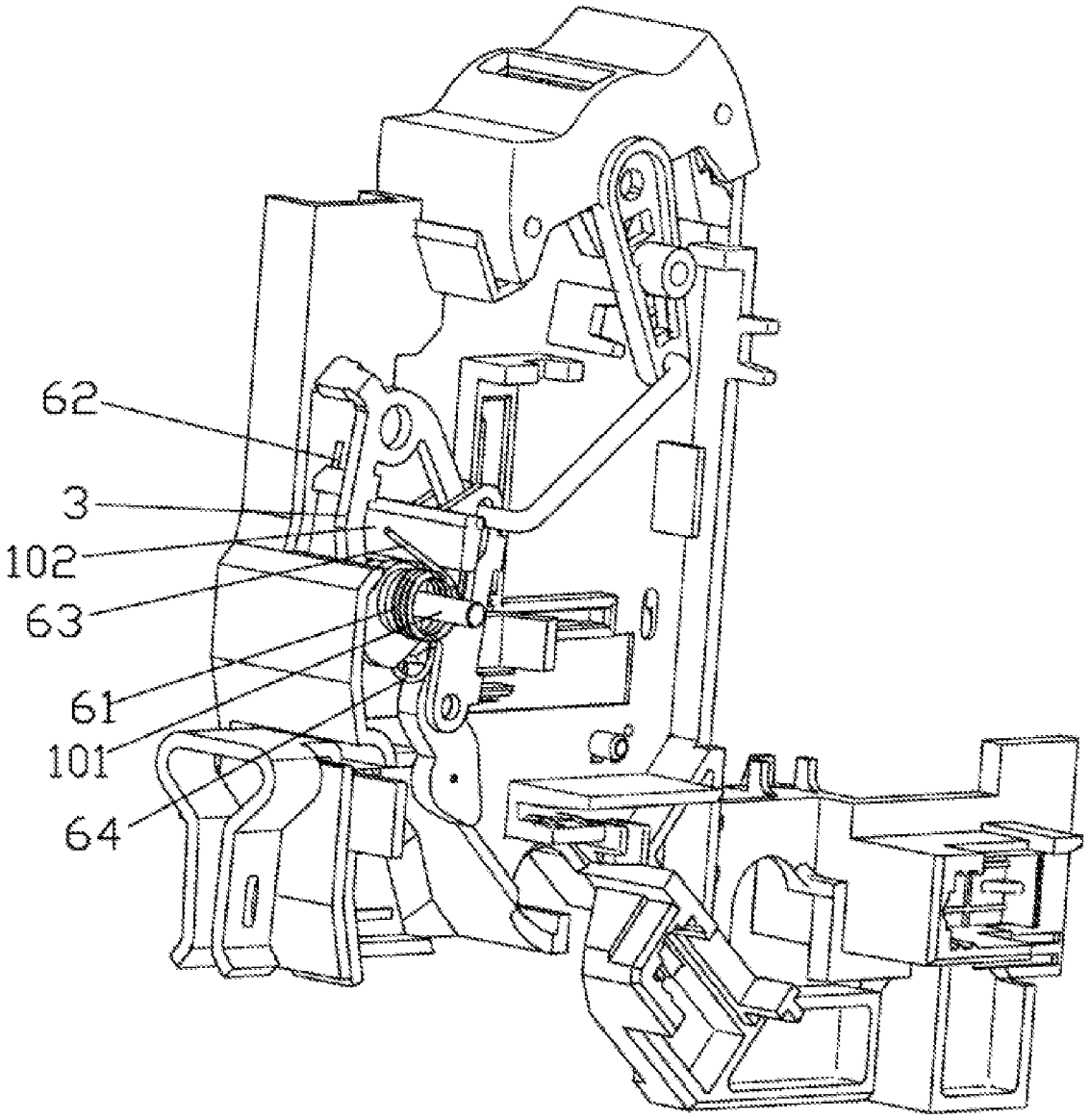
FIG. 3 is the structure schematic diagram two of the present disclosure in which the operating handle is in the opening position.

The miniature circuit breaker operating mechanism of the present disclosure has three states, namely, opening state, fault state and closing state, respectively. The opening state is as shown in FIG. 2 and FIG. 3. At this time, the moving contact 5 of the circuit breaker separates from the stationary contact 7, and the operating handle 1 is in the opening position. The first convex shaft 21 of the second connecting rod 2 is located at the top of the upper slot section 411, and the first acting portion 31 on the side of the lock catch 3 presses against the first convex shaft 21 of the second connecting rod 2, but does not restrict the first convex shaft 21 from sliding downward.

Figure 4:
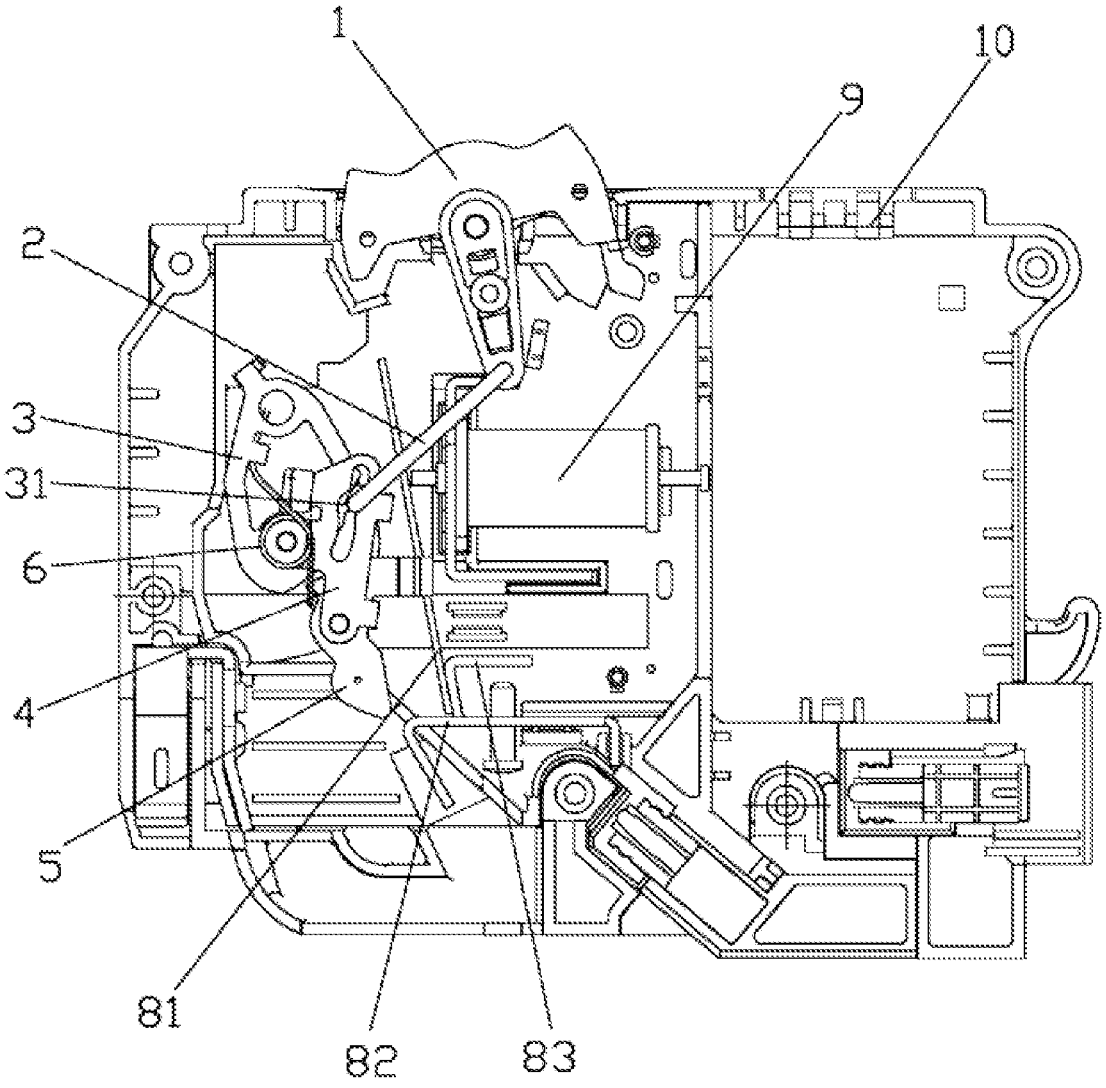
FIG. 4 is the structure schematic diagram of the operating handle of the present disclosure after rotating a certain empty stroke.
Figure 5:
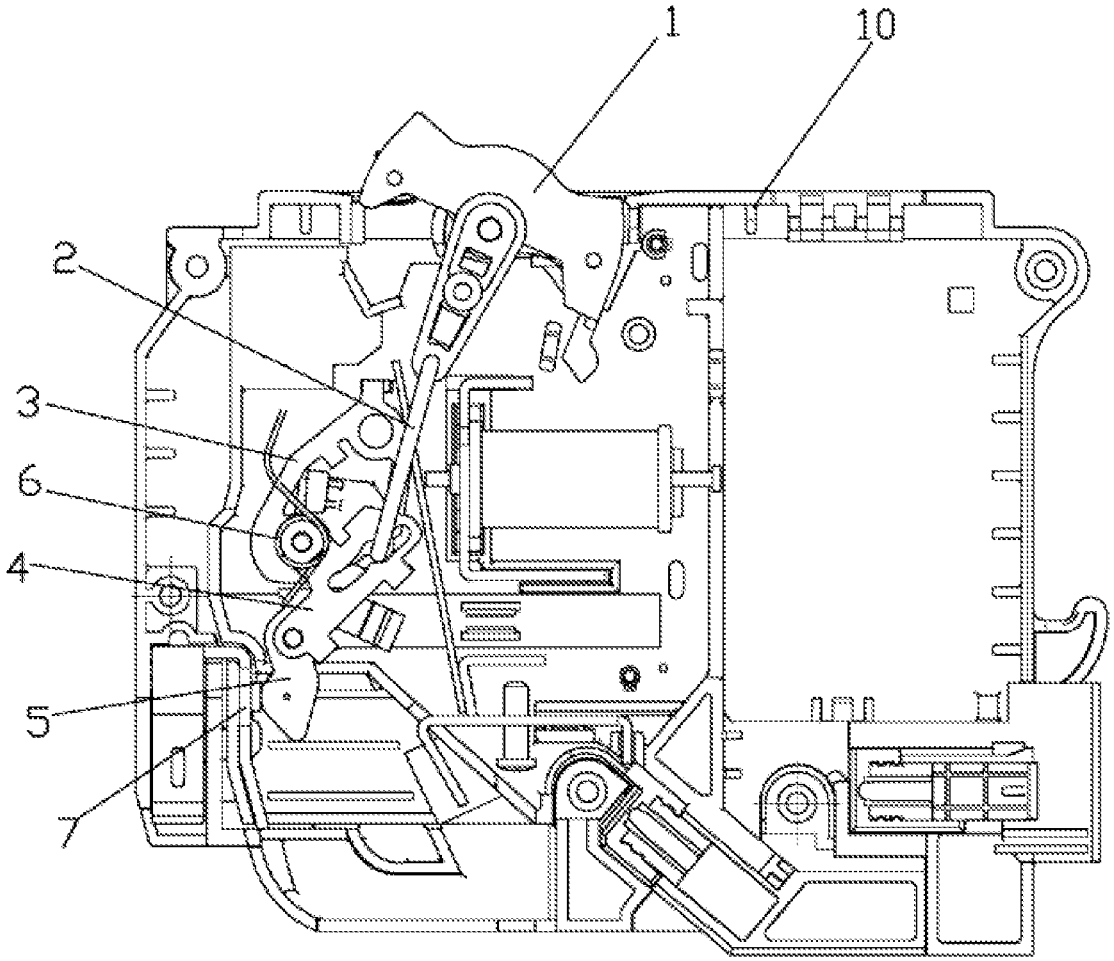
FIG. 5 is the structure schematic diagram of the present disclosure in which the operating handle is in the closing position.
Figure 6:
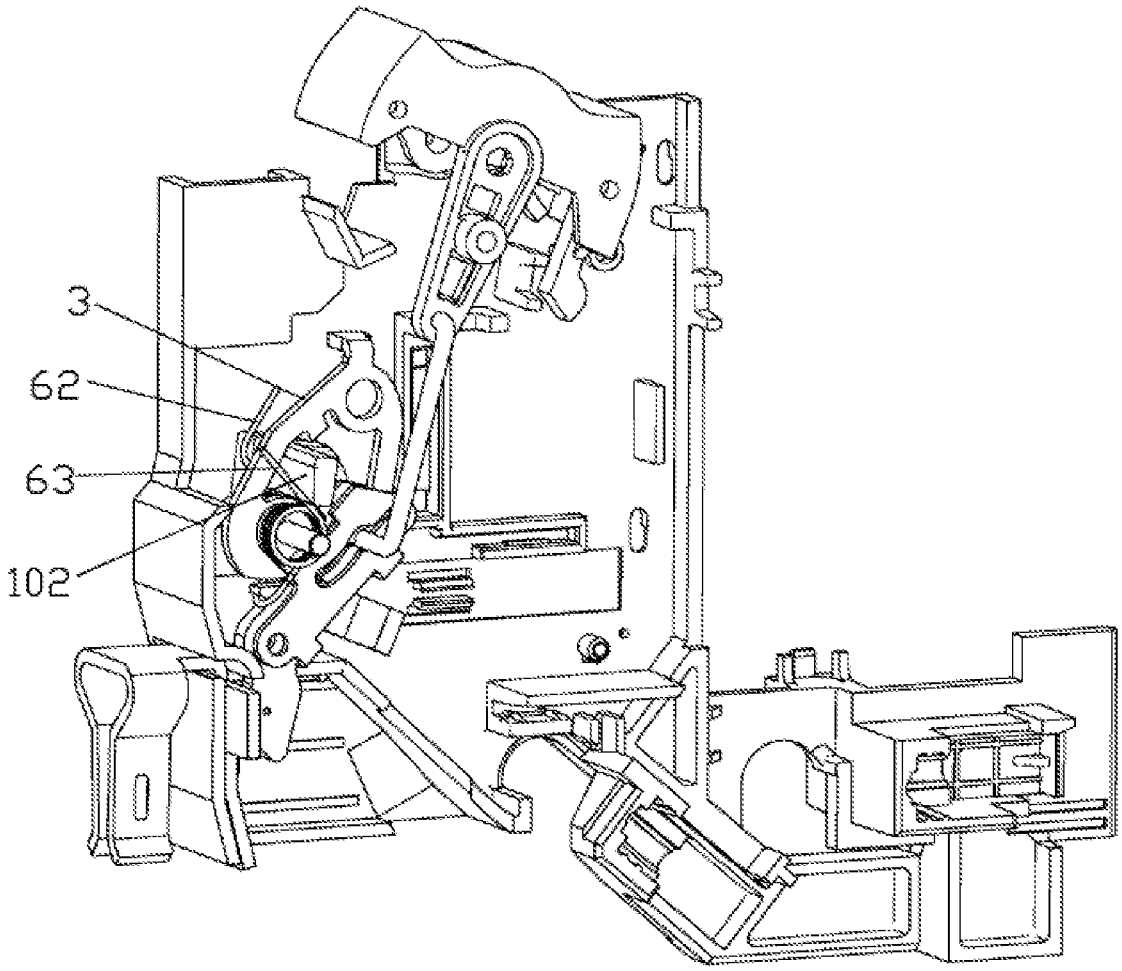
FIG. 6 is the structure schematic diagram one of the operating mechanism of the present disclosure in which the operating handle is in the closing position.
Figure 7:
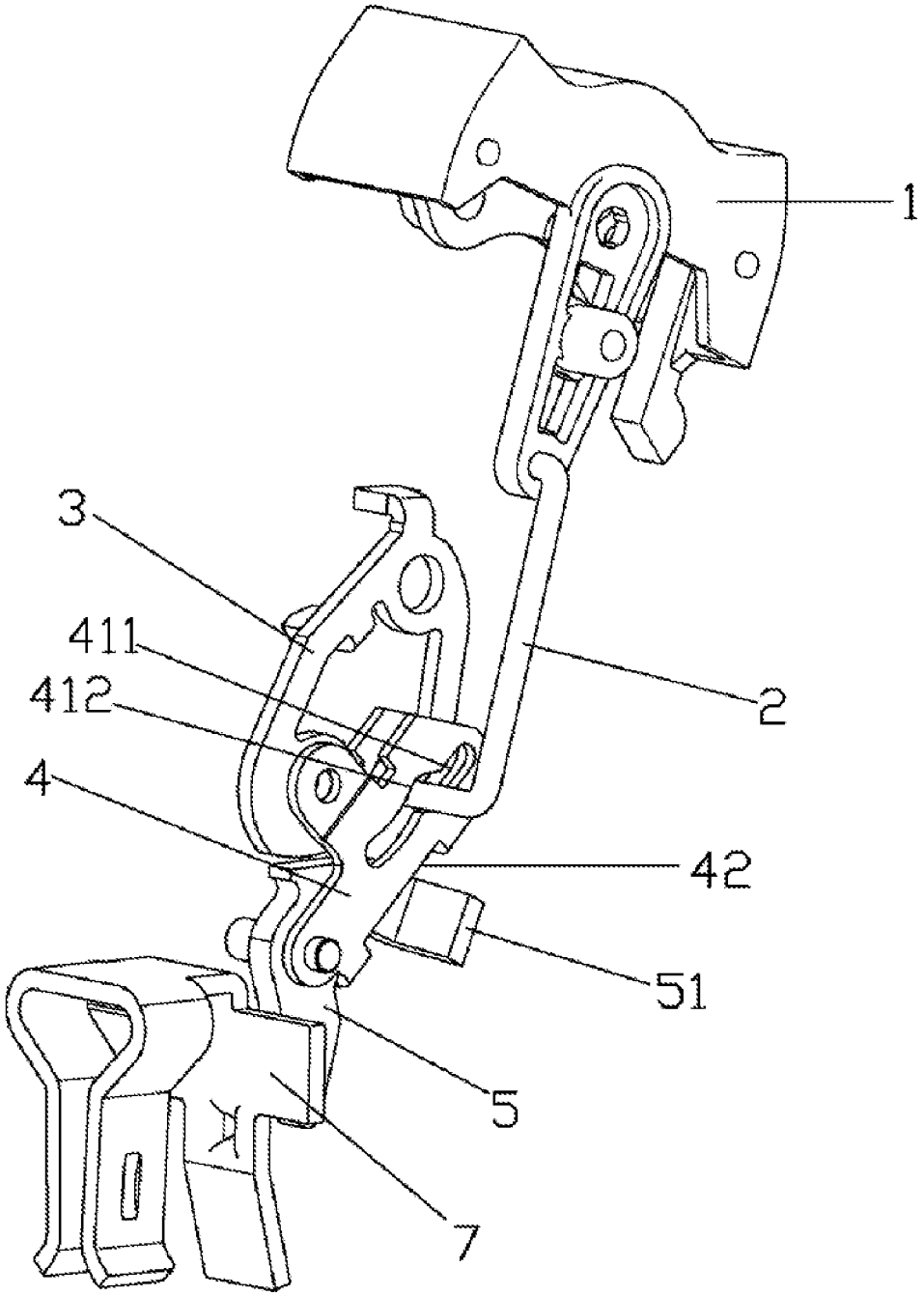
FIG. 7 is the structure schematic diagram two of the operating mechanism of the present disclosure in which the operating handle is in the closing position.

When closing, the "ON" end of the operating block 11 on the operating handle 1 is pressed, so that the entire operating handle 1 overcomes the elastic force of the third elastic member 13 to rotate to the closing position. During the rotating process, the first convex shaft 21 of the second connecting rod slides down from the upper slot section 411 of the sliding slot to the middle slot section 412 of the sliding slot, and the first acting portion 31 of the lock catch 3 tightly presses the first convex shaft 21 of the second connecting rod 2 against the inner wall of the middle slot section 412, as shown in FIG. 4. At this time, as the operating handle 1 continues to rotate, the operating handle 1 starts to drive the first connecting rod 4 and the lock catch 3 to rotate through the second connecting rod 2. When the lock catch 3 rotates to the second angle position, one foot 62 of the double twist spring 6 is stopped by the stop portion 102 to release the lock catch 3. At this time, the friction force generated by the rotation of the second connecting rod 2 to the lock catch 3 causes the lock catch 3 to always have a tight force with the first connecting rod 4 and the second connecting rod 2, so that the lock catch 3 can continue to rotate with the first connecting rod 4 until the moving contact 5 is closed and the moving contact 5 is kept in the closing state. As the first connecting rod 4 rotates, the moving contact 5 on the first connecting rod 4 also rotates towards the direction of the stationary contact 7 until the two are in contact, as shown in FIG. 5-FIG. 7. When the operating handle 1 is rotated to the closing position, the friction force effect of the lock catch 3 on the second connecting rod 2 causes the lock catch 3 to pull the operating handle 1 through the second connecting rod 2, so that the operating handle 1 can be kept in the closing position, without being reversed under the action of the third elastic member 13.

Figure 8:
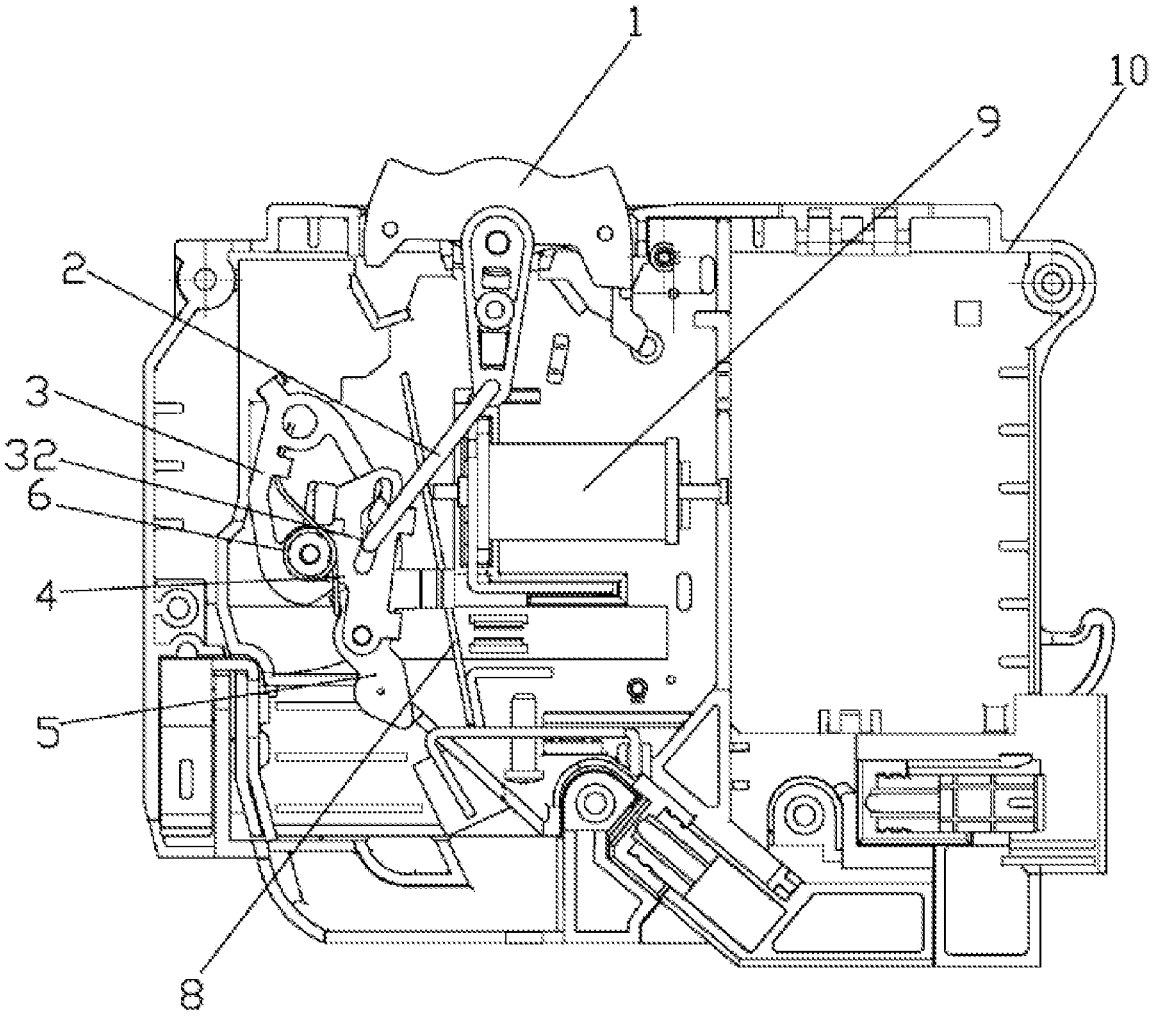
FIG. 8 is the structure schematic diagram of the present disclosure in which the operating handle is in the fault position.
Figure 9:
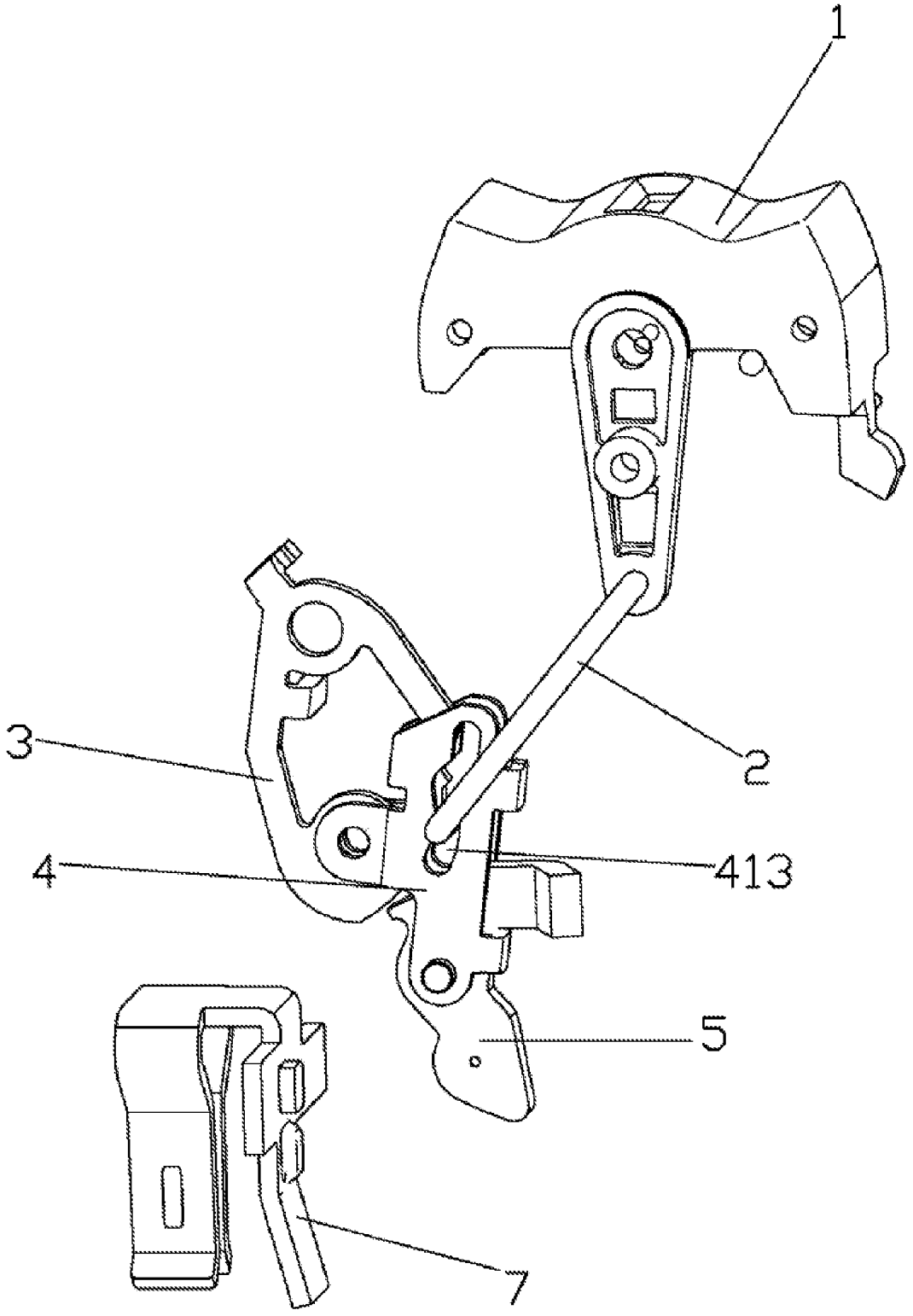
FIG. 9 is the structure schematic diagram of the operating mechanism of the present disclosure in which the operating handle is in the fault position.

When the tripping mechanism of the circuit breaker acts to push the lock catch 3 to trip, the lock catch 3 rotates in the reverse direction, so that the first acting portion 31 disengages from the first convex shaft 21 of the second connecting rod 2, and the lock catch 3 releases the position limit of the moving contact 5 and the first connecting rod 4, and the first connecting rod 4 and the moving contact 5 reversely rotate under the action of the double twist spring 6 to realize the opening. At the same time, the operating handle 1 rotates under the action of the elastic force of the third elastic member 13 to the opening position, and as the first connecting rod 4 rotates, the first convex shaft 21 of the second connecting rod 2 slides to the lower slot section 413 of the sliding slot of the first connecting rod 4. Moreover, the lock catch 3 is under the action of the double twist spring 6 and rotates in a direction opposite to the tripping direction, so that the second acting portion 32 thereof presses the first convex shaft 21 of the second connecting rod 2 against the inner wall of the lower slot section 413 of the sliding slot, as shown in FIG. 8 and FIG. 9, thereby restricting the continuous rotation of the operating handle 1. At this time, the operating handle 1 just rotates to the middle position, that is, the fault position, as shown in FIG. 8. The personnel can judge the fault of the circuit breaker through the position of the operating handle 1 at this time, and quickly carry out emergency treatment.

When the operating handle 1 is in the fault position, the personnel turns the operating handle 1 to the opening position by pressing the "OFF" end of the operating block 11 on the operating handle 1 to facilitate the subsequent closing. In this process, the manpower overcomes the action of the double twist spring 6 on the lock catch 3, so that the second acting portion 32 of the lock catch 3 separates from the first convex shaft 21 of the second connecting rod 2. The second connecting rod 2 follows the operating handle 1 to move, which causes the first convex shaft 21 thereof to return to the top of the upper slot section 411 of the sliding slot. When the operating handle 1 rotates to the opening position, the lock catch 3 is under the action of the double twist spring 6 to restore the first acting portion 31 to a state in which the first convex shaft 21 of the second connecting rod 2 is pressed, so as to facilitate the subsequent closing.

When the circuit breaker is in the closing state, the personnel can make the circuit breaker open by pressing the "OFF" end of the operating block 11 on the operating handle 1.

The present disclosure adopts that the operating handle 1, the lock catch 3, the first connecting rod 4 and the second connecting rod 2 constitute a four-bar linkage mechanism, which drives the moving contact 5 and the stationary contact 7 of the circuit breaker to open and close. Compared with the prior art of the miniature circuit breaker operating mechanism, not only the required components are greatly reduced, the assembly is simpler, and the cost is lower, but also the rotation angle of the operating handle 1 is half of the rotation angle of the existing product, so that the internal space of the circuit breaker can be further reduced to realize further miniaturization of the circuit breaker.

Please refer to FIG. 1-FIG. 9, a miniature circuit breaker of the present disclosure includes a housing 10, a moving contact 5, a stationary contact 7, an operating mechanism and a tripping mechanism. The operating mechanism is a miniature circuit breaker operating mechanism of the present disclosure above mentioned. The tripping mechanism includes the thermal tripping mechanism 8 and the magnetic tripping mechanism 9, but is not limited thereto.

In the present embodiment, the thermal tripping mechanism 8 includes a bimetal element 81 and a locating element 82. The bimetal element 81 is arranged on the locating element 82. The locating member 82 is fixed to the housing 10 by a bolt 83 matched with a nut, and the gap between the bimetal element 81 and the lock catch 3 can be changed by adjusting the position of the bolt 83. The bimetal element 81 is fixed on the housing 10 through the locating element 82, which prevents the bimetal element 81 from being directly located on the housing 10. Therefore, the water absorbing deformation of the housing 10 is not directly transmitted to the bimetal element 81, so that the delay performance of the circuit breaker is more stable.

In the present embodiment, the magnetic tripping mechanism 9 includes a moving iron core, a stationary iron core, a pushrod, an iron core spring, a coil, and a coil frame. The coil frame is arranged on the housing 10, and the coil is wound on the coil frame. The stationary iron core and the moving iron core are coaxially arranged through the coil frame. The pushrod passes through the stationary iron core, and one end thereof is connected with the moving iron core, and the other end is connected with the stationary iron core. The iron core spring sleeves on the pushrod and is pressingly arranged between the stationary iron core and the moving iron core.

When the circuit breaker is overloaded, the bimetal element 81 is heated and bent to the side where the lock catch 3 is located, thereby pushing the lock catch 3, causing the lock catch 3 to trip, and opening the circuit breaker.

When the overload circuit or the short-circuited circuit passes through the circuit breaker, the moving iron core drives the pushrod to move, so that the pushrod pushes the lock catch 3 to trip, and the circuit breaker is opened.

A miniature circuit breaker of the present disclosure, the opening and closing process of the operating mechanism thereof is as described above, therefore, no further details are provided.

The above-described embodiments are only used to further explain a miniature circuit breaker operating mechanism and a miniature circuit breaker of the present disclosure, but the present disclosure is not limited to the embodiments. Any simple modification, equivalent change and modification of the above-described embodiments according to the technical essence of the present disclosure all fall within the scope of protection of the technical solutions of the present disclosure.

What is claimed is:

1. A miniature circuit breaker operating mechanism, comprising:

an operating handle, configured to realize opening and closing of a circuit breaker;

a lock catch, configured to keep a moving contact of the circuit breaker in a closed state, and the operating handle and the lock catch being rotatably connected to a circuit breaker housing, respectively;

a first connecting link, being rotationally connected to the circuit breaker housing, and wherein the first connecting link and the lock catch share and rotate around a same rotating shaft, the moving contact being arranged on the first connecting link; and a second connecting link, being connected with the operating handle, and being matched with the lock catch and the first connecting link to cooperate with a linkage structure, wherein when the operating handle is rotating to a closed position, the second connecting link is driving the lock catch and the first connecting link to rotate to realize closing, and wherein when the lock catch is tripped, a position limit of the moving contact and the first connecting link is released, so that the moving contact and the first connecting link are restored under action of a first elastic member.

2. The miniature circuit breaker operating mechanism according to claim 1, wherein the linkage structure comprises a sliding slot arranged on the first connecting link, a first convex shaft arranged on the second connecting link and a first acting portion arranged on the lock catch; the first convex shaft is slidably connected into the sliding slot; the first acting portion is provided with a pressed state in which the first convex shaft is tightly pressed against the inner wall of the sliding slot, and a separated state separated from the first convex shaft; in the pressed state, the second connecting link can drive the first connecting link and the lock catch to rotate; in the separated state, the lock catch releases the position limit of the moving contact and the first connecting link.

3. The miniature circuit breaker operating mechanism according to claim 2, wherein a second elastic member is pressingly arranged between the lock catch and the circuit breaker housing; when the operating handle rotates to an open position, the lock catch is under action of the second elastic member, so that the first acting portion thereof restores to a state of being pressed against the first convex shaft.

4. The miniature circuit breaker operating mechanism according to claim 3, wherein a third elastic member is arranged between the operating handle and the circuit breaker housing; a second acting portion is arranged on the lock catch, and when the operating handle rotates a first angle to the open position under action of the third elastic member, the lock catch is under the action of the second elastic member, so that the second acting portion thereof is tightly pressed the first convex shaft against the inner wall of the sliding slot to restrict the operating handle to continue rotating to the open position.

5. The miniature circuit breaker operating mechanism according to claim 3, wherein further comprises a stop portion, which is arranged on the circuit breaker housing; when the lock catch rotates a second angle with the first connecting link, the stop portion presses an acting site of the second elastic member against the lock catch, so that the second elastic member releases the lock catch.

6. The miniature circuit breaker operating mechanism according to claim 3, wherein the first elastic member and the second elastic member are integrally connected to form a double twist spring, and two spiral portions of the double twist spring are sleeved on a rotating shaft of the lock catch; one foot of the double twist spring is lapped on the lock catch, and the other foot is lapped on the circuit breaker housing; the connection portion between the two spiral portions of the double twist spring hooks the moving contact.

7. The miniature circuit breaker operating mechanism according to claim 2, wherein the sliding slot comprises an upper slot section and a lower slot section, and a bottom end of the upper slot section is connected with a bottom end of the lower slot section through a middle slot section; when the first convex shaft of the second connecting link slides from the upper slot section to the middle slot section, the second connecting link drives the first connecting link and the lock catch to rotate as the operating handle continues to rotate to the closed position.

8. The miniature circuit breaker operating mechanism according to claim 3, wherein the sliding slot comprises an upper slot section and a lower slot section, and a bottom end of the upper slot section is connected with a bottom end of the lower slot section through a middle slot section; when the first convex shaft of the second connecting link slides from the upper slot section to the middle slot section, the second connecting link drives the first connecting link and the lock catch to rotate as the operating handle continues to rotate to the closed position.

9. The miniature circuit breaker operating mechanism according to claim 4, wherein the sliding slot comprises an upper slot section, a middle slot section and a lower slot section, and a bottom end of the upper slot section is connected with a top end of the lower slot section through the middle slot section; when the first convex shaft of the second connecting link slides from the upper slot section to the middle slot section, the second connecting link drives the first connecting link and the lock catch to rotate as the operating handle continues to rotate to the closed position; when the operating handle rotates a first angle to the open position under the action of the third elastic member, the second acting portion of the lock catch tightly presses the first convex shaft against the inner wall of the lower slot section.

10. The miniature circuit breaker operating mechanism according to claim 1, wherein the operating handle is provided with a shaft hole, and the second connecting link is provided with a second convex shaft, and the second convex shaft is movably inserted into the shaft hole.

11. The miniature circuit breaker operating mechanism according to claim 1, wherein the moving contact is hinged on the first connecting link, and the first connecting link is provided with a receiving slot; the moving contact is provided with a bump block, and the bump block is fitted into the receiving slot and has a gap with a slot wall of at least one side of the receiving slot.

12. A miniature circuit breaker operating mechanism, comprising a housing, a moving contact, a stationary contact, an operating mechanism and a tripping mechanism, wherein, the operating mechanism is the miniature circuit breaker operating mechanism of claim 1.

* * * * *